US007617756B2

(12) United States Patent
Noguchi et al.

(10) Patent No.: US 7,617,756 B2
(45) Date of Patent: Nov. 17, 2009

(54) INDEX CUTTER

(75) Inventors: Makoto Noguchi, Yokosuka (JP); Yasuhisa Mizutani, Kawaguchi (JP)

(73) Assignee: Makoto Noguchi, et al. (JP)

( * ) Notice: Subject to any disclaimer, the term of this patent is extended or adjusted under 35 U.S.C. 154(b) by 152 days.

(21) Appl. No.: 11/578,380

(22) PCT Filed: Apr. 13, 2005

(86) PCT No.: PCT/JP2005/007131

§ 371 (c)(1),
(2), (4) Date: Dec. 5, 2006

(87) PCT Pub. No.: WO2005/099978

PCT Pub. Date: Oct. 27, 2005

(65) Prior Publication Data

US 2007/0163411 A1 Jul. 19, 2007

(30) Foreign Application Priority Data

Apr. 14, 2004 (JP) ..... 2004-119577

(51) Int. Cl.
*B26D 5/08* (2006.01)

(52) U.S. Cl. ..... 83/599; 83/904; 83/917; 83/589; 83/611

(58) Field of Classification Search ..... 83/904, 83/589, 917, 611, 599, 94, 582, 588, 633, 83/628, 597
See application file for complete search history.

(56) References Cited

U.S. PATENT DOCUMENTS

| | | | | |
|---|---|---|---|---|
| 775,568 | A * | 11/1904 | La May | 30/28 |
| 1,125,577 | A * | 1/1915 | Manypenny | 30/29 |
| 4,033,037 | A * | 7/1977 | Cooley | 30/363 |
| 4,917,523 | A | 4/1990 | Merrick et al. | |
| 6,116,132 | A * | 9/2000 | Kamijo | 83/599 |
| 6,343,533 | B1 * | 2/2002 | Kamijo | 83/599 |
| 6,581,501 | B2 * | 6/2003 | McGrath | 83/467.1 |
| 6,647,842 | B1 | 11/2003 | Krasik-Geiger et al. | |

FOREIGN PATENT DOCUMENTS

| | | |
|---|---|---|
| JP | 25-6310 | 9/1950 |
| JP | 62-152698 | 7/1987 |
| JP | 62-201697 | 12/1987 |
| JP | 63-97324 | 6/1988 |
| JP | 02-40372 | 3/1990 |

* cited by examiner

*Primary Examiner*—Ghassem Alie
*Assistant Examiner*—Bharat C Patel
(74) *Attorney, Agent, or Firm*—NDQ&M Watchstone LLP

(57) ABSTRACT

An index cutter (I) forms a thumb index on a sheet. The index cutter (I) includes: a flat plate-shaped first base member (1) having a first blade portion; and a flat plate-shaped second base member (2) rotatable coupled to the first base member (1) and having a second blade portion. When the first base member (1) and the second base member (2) are rotated relatively to each other, a part of the sheet is cut by the first blade portion and the second blade portion.

4 Claims, 7 Drawing Sheets

INDEX CUTTER

TECHNICAL FIELD

The present invention relates to an index cutter for use in forming a thumb index.

BACKGROUND ART

A tap index and a thumb index have been heretofore known as indices for identifying contents described in documents, books and the like.

The tap index includes an index body formed of paper or plastics, and an adhesive portion formed by adhering glue onto one end of the index body. The tap index is pasted onto a desired page of a document through the adhesive portion so that the other end of the index body can protrude from an end of the document.

The tap index has the following drawbacks: (1) the tap index is pasted on only one page of the document, and accordingly, is unsuitable for identifying a plurality of pages (page group); (2) the tap index is pasted onto the desired page of the document so that the other end of the index body can protrude from the end of the document, and accordingly, the document including the tap index is difficult to be enclosed in an envelope or a file; and (3) the tap index is prone to be detached from the document when touching an external factor such as a finger of a user.

The thumb index is formed on an end portion of a desired page group of a book by a thumb punch 101 shown in FIG. 1. The thumb index is formed by directly cutting the end portion of the page group, and accordingly overcomes the drawbacks of the tap index, which are described above.

However, the thumb punch 101 is upsized in order to cut the end portion of the desired page group including a large number of pages at one time. Therefore, the thumb punch 101 has a wasted space in terms of cutting an end portion of a desired page group including a small number of pages or cutting an end portion of a desired page. Moreover, since the thumb punch 101 has, on a tip end thereof, a circular-arc cutting edge 103 exposed from the thumb punch 101, it is difficult for the user to carry the thumb punch 101 with easiness.

DISCLOSURE OF THE INVENTION

It is a first object of the present invention to provide an index cutter for use in simply cutting the desired page group including the small number of pages or the desired page.

It is a second object of the present invention to provide an index cutter excellent in portability.

It is a third object of the present invention to provide an index cutter with which clerical functions are integrated together.

In order to achieve the foregoing objects, the present invention provides an index cutter configured to form a thumb index on a sheet, comprising: a flat plate-shaped first base member having a first blade portion; and a flat plate-shaped second base member rotatably coupled to the first base member and having a second blade portion, wherein, when the first base member and the second base member are rotated relatively to each other, a part of the sheet is cut by the first blade portion and the second blade portion.

According to the present invention, the index cutter rotates the first base member and the second base member relatively to each other, thereby cutting a part of the desired page group including a small number of pages or a part of the desired page. Accordingly, the index cutter can form the thumb indices on a document, a book, and the like with easiness. Moreover, the index cutter is formed compactly into a flat plate shape, and accordingly, can reduce a space for disposing the index cutter itself, and is excellent in portability.

BEST MODE FOR CARRYING OUT THE INVENTION

A description will be made of an index cutter of the present invention with reference to FIG. 2 to FIG. 10B.

Figure 1:
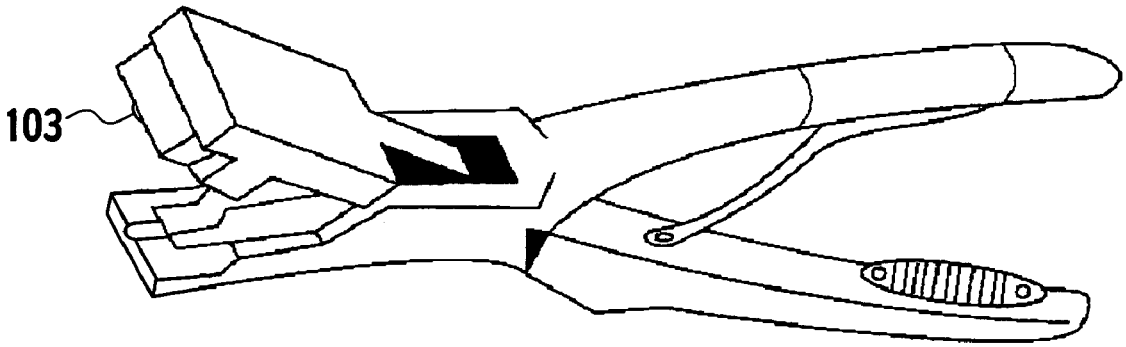
FIG. 1 PRIOR ART
FIG. 1 is a perspective view of a conventional thumb punch.
Figure 2:
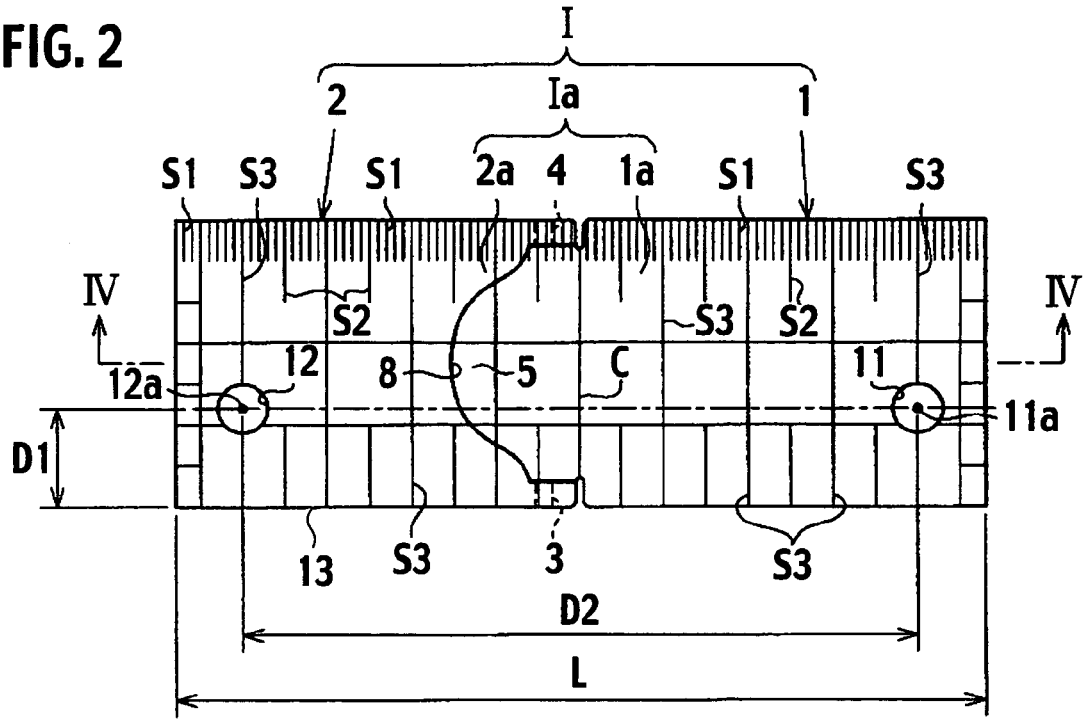
FIG. 2 is a front view of an index cutter according to an embodiment of the present invention.
Figure 3A:
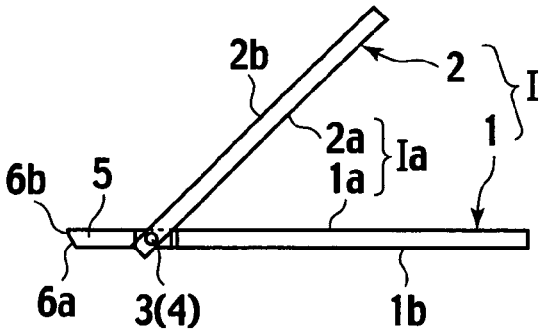
FIG. 3A is a side view of the index cutter according to the embodiment of the present invention at a standby position.
Figure 3B:
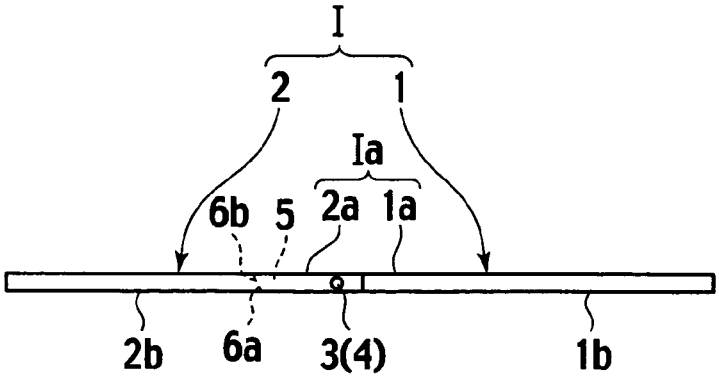
FIG. 3B is a side view of the index cutter according to the embodiment of the present invention at a cutting position.

As shown in FIG. 2, an index cutter I is formed to be flat, and is made of metal such as steel, stainless steel, and aluminum. The index cutter I has a length L of 96 mm, and includes a first base member 1 and a second base member 2. The first base member 1 is formed to be flat, and has a thickness of 2.5 mm. The first base member 1 has a front surface 1*a* and a back surface 1*b*. The second base member 2 is formed to be flat, and has a thickness of 2.5 mm. The second base member 2 has a front surface 2*a* and a back surface 2*b*. To the first base member 1, the second base member 2 is coupled through coupling pins 3 and 4 penetrated through one end side thereof. As shown in FIGS. 3A and 3B, the first base member 1 and the second base member 2 rotate relatively to each other about the coupling pins 3 and 4.

Figure 4:
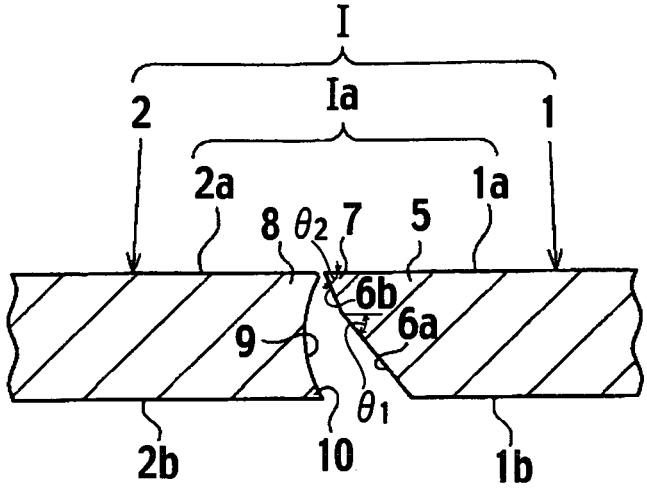
FIG. 4 is a cross-sectional view along a line IV-IV in FIG. 2.

As shown in FIG. 2, an engaging protruding portion 5 is formed into substantially a circular arc shape, and is extended from one end of the first base member 1 toward the second base member 2. As shown in FIG. 4, the engaging protruding portion 5 includes a first inclination surface 6*a*, a second inclination surface 6*b*, and a first blade portion 7. The first inclination surface 6*a* is formed on a lower portion of a side surface of the engaging protruding portion 5 so as to be inclined from the back surface 1*b* toward the second base member 2. The second inclination surface 6*b* is continuously connected to the first inclination surface 6*a*, and is formed on an upper portion of the side surface of the engaging protruding portion 5 so as to be inclined from the front surface 1*a* toward the first base member 1. An inclination angle $\theta_2$ ($0°<\theta_2<90°$) of the second inclination surface 6*b* with respect to the front surface 1*a* is larger than an inclination angle $\theta_1$ ($0°<\theta_1<90°$) of the first inclination surface 6*a* with respect to the front surface 1*a*. The first blade portion 7 is formed on a tip end portion of the engaging protruding portion 5 on the front surface 1*a* side. The side surface of the engaging protruding portion 5 is formed so that the inclination angle θ2 can be larger than the inclination angle θ1, and accordingly, strength of the first blade portion 7 is enhanced. A tip end portion of the first blade portion 7 is formed into substantially a circular arc shape in response to the shape of the engaging protruding portion 5.

Figure 5:
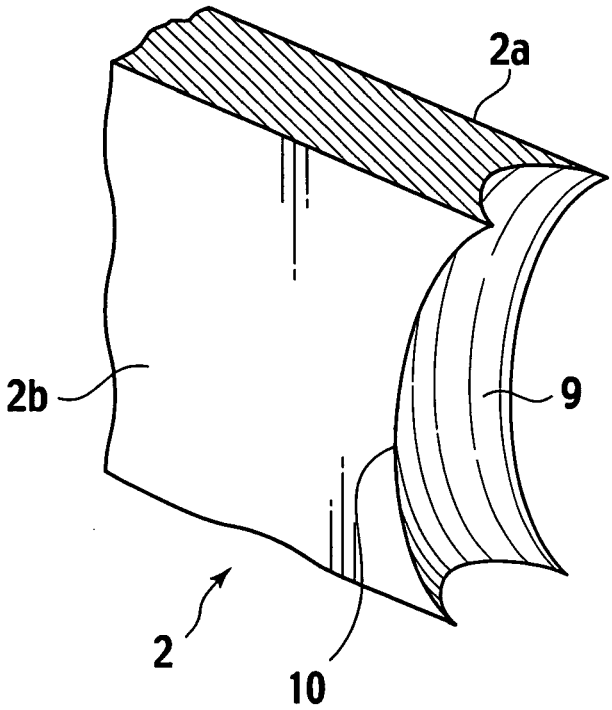
FIG. 5 is a partial enlarged perspective view of a second base member according to the embodiment of the present invention.
Figure 6A:
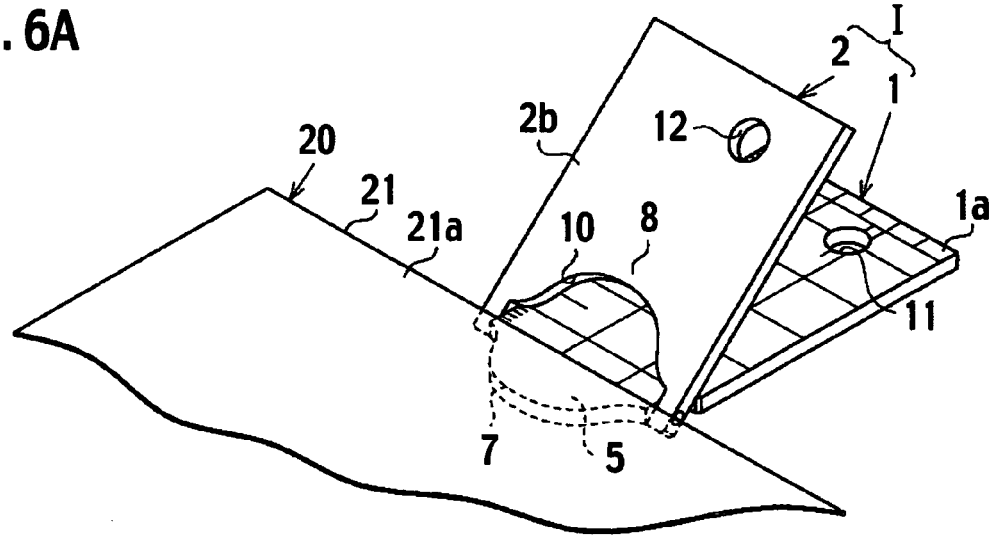
FIG. 6A is a perspective view for explaining a usage method of the index cutter according to the embodiment of the present invention.
Figure 6B:
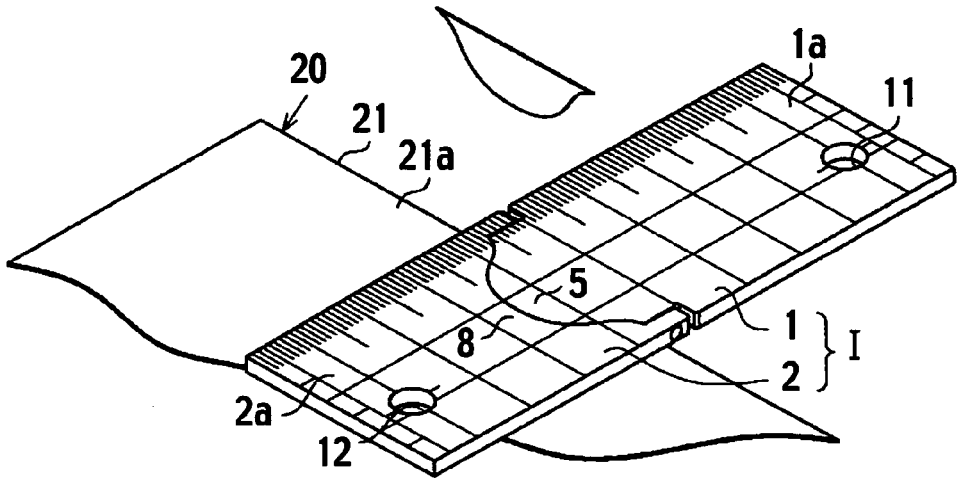
FIG. 6B is a perspective view for explaining a first usage method of the index cutter according to the embodiment of the present invention.
Figure 6C:
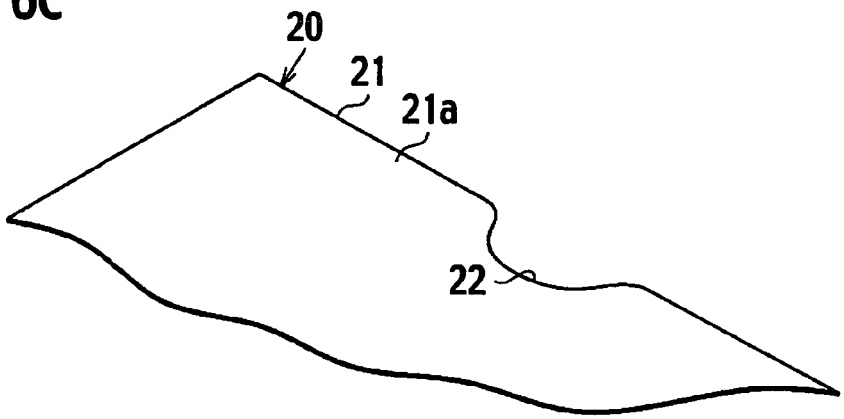
FIG. 6C is a perspective view for explaining the first usage method of the index cutter according to the embodiment of the present invention.

As shown in FIG. 2, an engaging recessed portion 8 is formed into substantially a circular arc shape, and is extended from one end of the second base member 2 toward the first base member 1. As shown in FIG. 4, the engaging recessed portion 8 includes a clearance groove 9 and a second blade portion 10. As shown in FIG. 5, the clearance groove 9 is formed on a side surface of the engaging recessed portion 8 by cutting out the side surface of the engaging recessed portion 8 by using an NC lathe so that the side surface concerned can be curved into substantially a saddle shape. When the first base member 1 and the second base member 2 rotate relatively to each other, the first blade portion 7 moves in the clearance groove 9. The second blade portion 10 is formed on a tip end portion of the engaging recessed portion 8 on the back surface 2*b* side. When the first base member 1 and the second base member 2 rotate relatively to each other, the second blade portion 10 cuts a sheet in cooperation with the first blade portion 7. A tip end portion of the second blade portion 10 is formed into substantially a circular arc shape in response to the shape of the engaging recessed portion 8.

Based on such a construction as described above, when the second base member 2 rotates about the coupling pins 3 and 4 from a standby position (refer to FIG. 3A) to a cutting position (refer to FIG. 3B), the first blade portion 7 is opposed to the second blade portion 10, and then moves in the clearance groove 9. Therefore, the first base member 1 and the second base member 2 smoothly rotate relatively to each other.

A scale S1 with an interval of 1 mm, a scale S2 with an interval of 5 mm, and a scale S3 with an interval of 10 mm are ditched on a front surface Ia (the front surface 1*a* of the first base member 1 and the front surface 2*a* of the second base member) of the index cutter I. Therefore, a user can use the index cutter I as a ruler. A centerline C is ditched at a position where the index cutter I is bisected in a longitudinal direction on the front surface Ia (the front surface 1*a* of the first base member 1) of the index cutter I, that is, at a position of 48 mm from both end portions of the index cutter I.

A first position confirmation hole 11 and a second position confirmation hole 12 are formed at both end portions of the index cutter I so as to be symmetric with respect to the centerline C. The first position confirmation hole 11 has a diameter of 6 mm, and is formed on the other end portion of the first base member 1 so as to penetrate the back surface 1*b* from the from surface 1*a*. A center point 11*a* of the first position confirmation hole 11 is apart from a long side 13 of the index cutter I by a distance D1 (12 mm). The second position confirmation hole 12 has a diameter of 6 mm, and is formed on the other end portion of the second base member 2 so as to penetrate the back surface 2*b* from the front surface 2*a*. A center point 12*a* of the second position confirmation hole 12 is apart from the long side 13 of the index cutter I by the distance D1 (12 mm). An interval D2 between the center points 11*a* and 12*a* is designed to be 80 mm, and conforms to the punch pitch of the Japanese Industrial Standard (JIS).

Next, a description will be made of a usage method of the index cutter I.

Figure 7A:
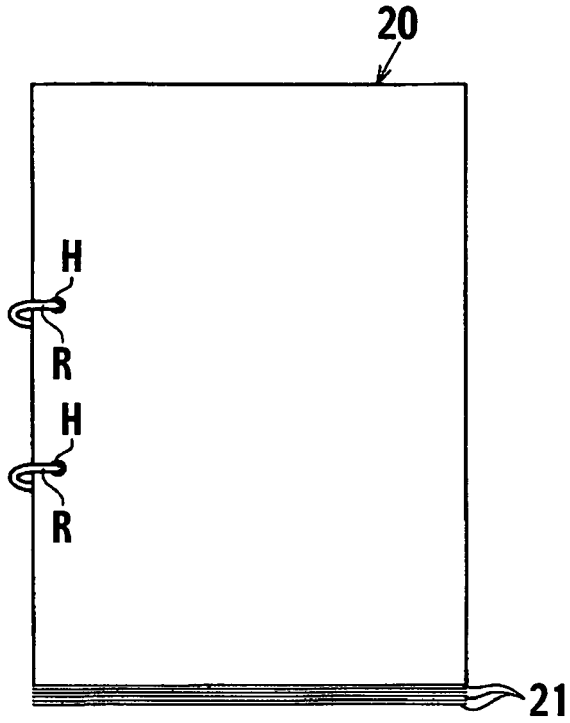
FIG. 7A is a plan view of a document before thumb indices are formed thereon, according to the embodiment of the present invention.

First, a description will be made of a method for forming a thumb index on a document. As shown in FIG. 7A, a document 20 includes a plurality of sheets 21. Each sheet 21 has a length of 297 mm and a width of 210 mm, and conforms to the A4 size of the Japanese Industrial Standard and the International Standardization Organization (ISO). The plurality of sheets 21 form the document 20 by allowing rings R and R to penetrate through holes H and H provided on left-end upper portions and left-end lower portions of the respective sheets 21.

Figure 7B:
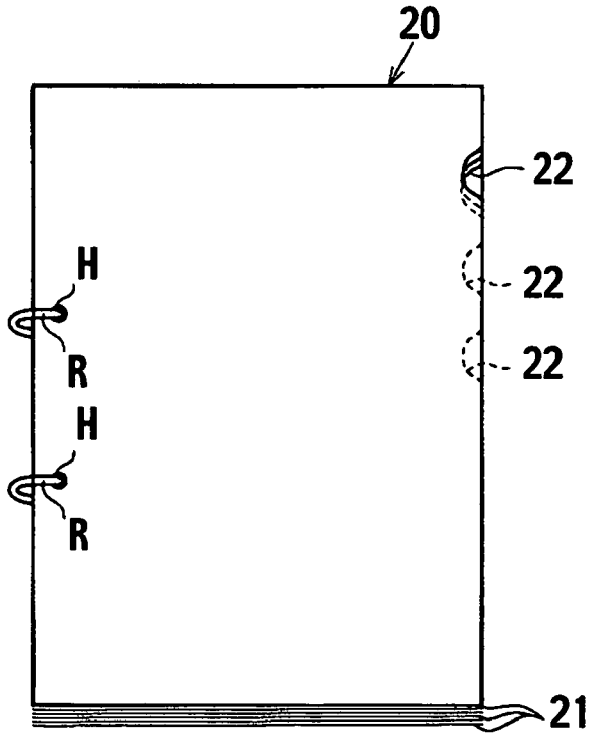
FIG. 7B is a plan view of the document after the thumb indices are formed thereon, according to the embodiment of the present invention.

First, the second base member 2 of the index cutter I is set at the standby position. Second, the sheet 21 on which the thumb index is to be formed is loaded onto the engaging protruding portion 5 of the first base member on the front surface 1*a* side, a side 21*a* of the sheet 21 is made to abut on the back surface 2*b* of the second base member 2, and the sheet 21 is thereby positioned (refer to FIG. 6A). Third, the second base member 2 is rotated from the standby position to the cutting position (refer to FIG. 6B). At this time, a part of the side 21*a* is cut by the first blade portion 7 and the second blade portion 10. Finally, the thumb index is formed on the side 21 along the side surface of the engaging protruding portion 5 and the side surface of the engaging recessed portion 8 (refer to FIG. 6C). As shown in FIG. 7B, thumb indices 22 are formed on a small number of the sheets 21 (a page group) or one piece of the sheet 21, thus making it possible for the user to identify contents described in the document 22 while referring to the thumb indices 22.

Next, a description will be made of a method for folding the sheet 21 into thirds by using the index cutter I. Since the sheet 21 has the length of 297 mm, the length L (96 mm) of the index cutter I is equal to approximate ⅓ of the length of the sheet 21.

Figure 8A:
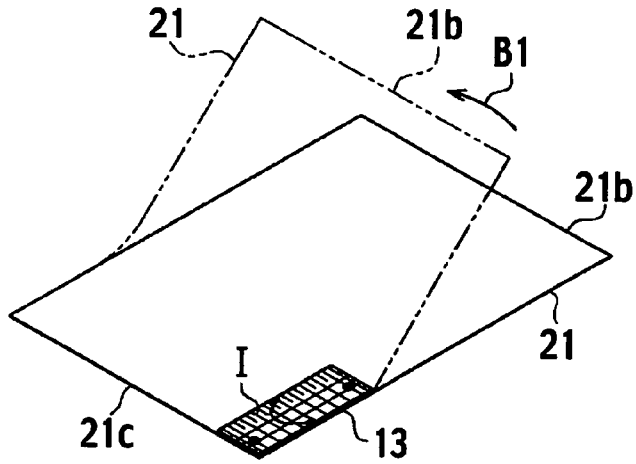
FIG. 8A is a perspective view for explaining a second usage method of the index cutter according to the embodiment of the present invention.
Figure 8B:
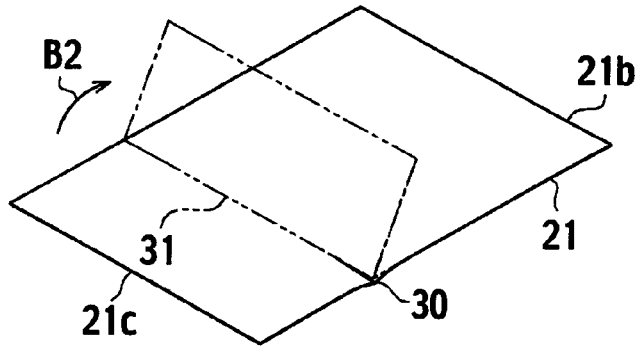
FIG. 8B is a perspective view for explaining the second usage method of the index cutter according to the embodiment of the present invention.
Figure 8C:
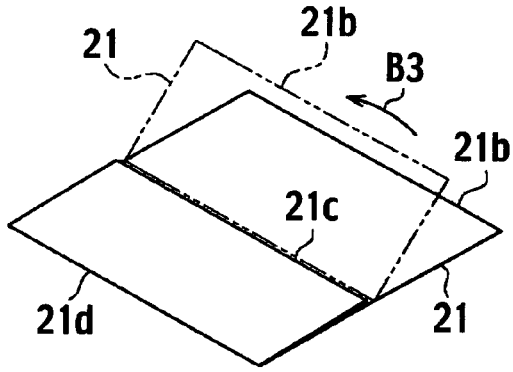
FIG. 8C is a perspective view for explaining the second usage method of the index cutter according to the embodiment of the present invention.
Figure 8D:
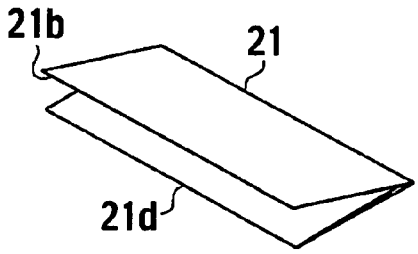
FIG. 8D is a perspective view for explaining the second usage method of the index cutter according to the embodiment of the present invention.
Figure 9:
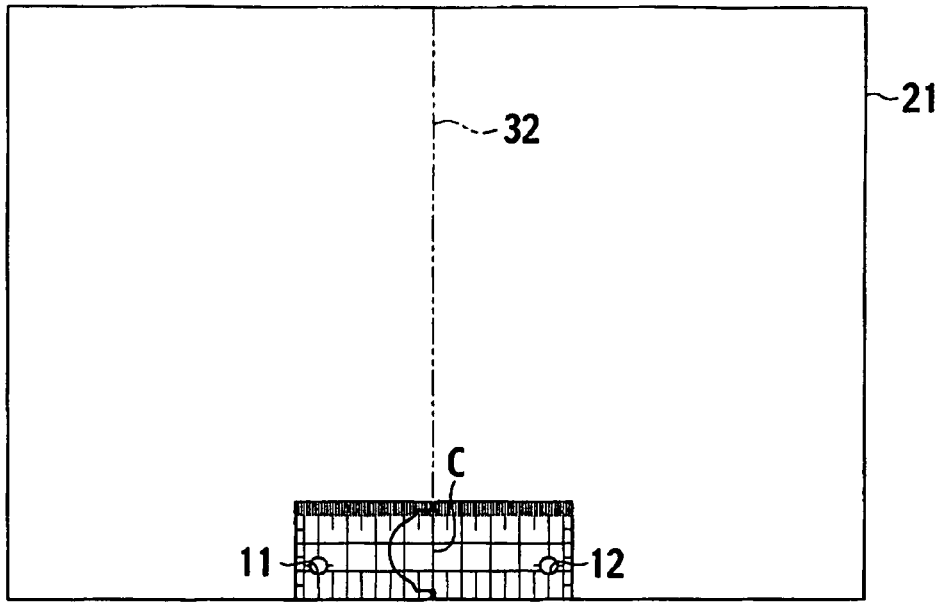
FIG. 9 is a plan view for explaining a third usage method of the index cutter according to the embodiment of the present invention.

First, the index cutter I is placed on the sheet 21 so that a left corner portion of the index cutter I can be superposed on a left corner portion of the sheet 21 (refer to FIG. 8A). Second, a right end portion of the index cutter I is pressed against the sheet 21 while the sheet 21 is being lifted in a direction of an arrow B1 from the side 21*b* side of the sheet 21. Thus, a folding crease 30 is formed on a spot where the index cutter I abuts on the sheet 21 (refer to FIG. 8B). Third, after removing the index cutter I from the sheet 21, the sheet 21 is folded in a direction of an arrow B2 from a side 21*c* side of the sheet 21 so that a folding line 31 parallel to the side 21*c* of the sheet 21 can be extended from the folding crease 30 (refer to FIG. 8C). Thus, an infolding side 21*d* is formed on the sheet 21. Finally, the sheet 21 is folded in a direction of an arrow B3 from the side 21*b* side of the sheet 21 so that the side 21*b* can somewhat cover the infolding side 21*d* (refer to FIG. 8D). Thus, the sheet 21 is easily folded into thirds.

Next, a description will be made of a method for confirming, by using the index cutter I, forming positions of punch holes formed by a puncher manufactured in conformity with the Japanese Industrial Standard. The interval D2 between the first position confirmation hole 11 and second confirmation hole 12 of the index cutter I conforms to the punch pitch of the Japanese Industrial Standard.

First, by folding the sheet 21 into halves, a centerline 32 is formed on the sheet 21. Next, the index cutter I is placed on the sheet 21 so that the centerline 32 can coincide with the centerline C of the index cutter I and that a long side of the sheet 21 and the long side of the index cutter I can be superposed on each other (refer to FIG. 9). At this time, the first position confirmation hole 11 and the second position confirmation hole 12 indicate the forming positions of the punch holes on a center portion of the long side of the sheet 21.

A description will be made of an effect of the index cuter I.

The index cutter I easily forms the thumb indices on a desired page group including a small number of pages or on a desired page by rotating the first base member 1 including the first blade portion 7 and the second base member 2 including the second blade portion 10 relatively to each other. Therefore, even in the case where the sheets 21 are mutually mixed up by releasing an engaged state of the rings R and R of the document 20, the user can easily sort the sheets 21 for each item by referring to the thumb indices 22.

The index cutter I has the length L (96 mm) which is approximate ⅓ of the length of each sheet 21 (of the A4 size). Therefore, the sheet 21 is easily folded into thirds by using the index cutter I. Moreover, the index cutter I is superior in portability to a thumb punch.

In the index cutter I, the interval D2 between the center point 11*a* of the first position confirmation hole 11 and the center point 12*a* of the second position confirmation hole 12 conforms to the punch pitch of the Japanese Industrial Standard. Therefore, before the punch holes are formed on the sheet 21 by a puncher, the user can confirm the forming positions of the punch holes formed on the sheet 21 by using the first position confirmation hole 11 and the second position confirmation hole 12. As a result, when characters and the like are described on the sheet 21, it can be avoided that a part of the characters and the like is cut out by the punch holes.

The index cutter I has the thickness of 2.5 mm and the length L of 96 mm. Therefore, when the index cutter I is put on a desk, the index cutter I can reduce a space for disposing the index cutter I itself in comparison with the thumb punch.

Since the index cutter I is formed into a flat plate shape, the document 20 and the like can be stacked on the index cutter I. Moreover, the index cutter I is made of metal such as steel, stainless steel, and aluminum, and is excellent in portability. Accordingly, the index cutter I is usable as a paper weight.

Figure 10A:
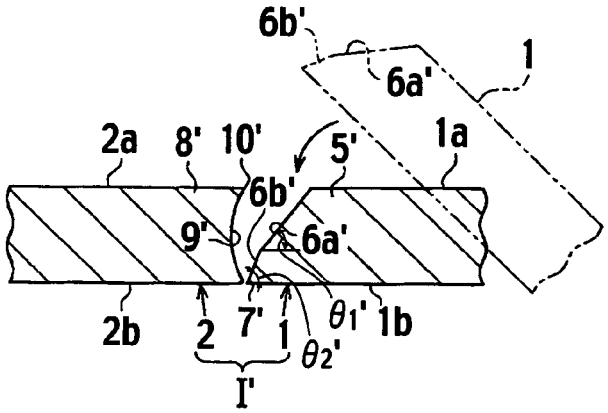
FIG. 10A is a cross-sectional view for explaining a first modification example of the index cutter according to the embodiment of the present invention.

A description will be made of a first modification example (an index cutter I') of the index cutter I. As shown in FIG. 10A, an engaging protruding portion 5' is formed into substantially a circular arc shape, and is extended from one end of the first base member 1 toward the second base member 2. The engaging protruding portion 5' includes a first inclination surface 6*a'*, a second inclination surface 6*b'*, and a first blade portion 7'. The first inclination surface 6*a'* is formed on an upper portion of a side surface of the engaging protruding portion 5' so as to be inclined from the front surface 1*a* toward the second base member 2. The second inclination surface 6*b'* is continuously connected to the first inclination surface 6*a'*, and is formed on a lower portion of the side surface of the engaging protruding portion 5' so as to be inclined from the back surface 1*b* toward the first base member 1. An inclination angle $\theta_2'$ ($0°<\theta_2'<90°$) of the second inclination surface 6*b'* with respect to the back surface 1*b* is larger than an inclination angle $\theta_1'$ ($0°<\theta_1'<90°$) of the first inclination surface 6*a'* with respect to the back surface 1*b*. The first blade portion 7' is formed on a tip end portion of the engaging protruding portion 5' on the back surface 1*b* side. The side surface of the engaging protruding portion 5' is formed so that the inclination angle $\theta_2'$ can be larger than the inclination angle $\theta_1'$, and accordingly, strength of the first blade portion 7' is enhanced. A tip end portion of the first blade portion 7' is formed into substantially a circular arc shape in response to the shape of the engaging protruding portion 5'.

As shown in FIG. 10A, an engaging recessed portion 8' is formed into substantially a circular arc shape, and is extended from one end of the second base member 2 toward the first base member 1. The engaging recessed portion 8' includes a clearance groove 9' and a second blade portion 10'. The clearance groove 9' is formed on a side surface of the engaging recessed portion 8' by cutting out the side surface of the engaging recessed portion 8' by using the NC lathe so that the side surface concerned can be curved into substantially a saddle shape. When the first base member 1 and the second base member 2 rotate relatively to each other, the first blade portion 7' moves in the clearance groove 9'. The second blade portion 10' is formed on a tip end portion of the engaging recessed portion 8' on the front surface 2*a* side. When the first base member 1 and the second base member 2 rotate relatively to each other, the second blade portion 10' cuts the sheet in cooperation with the first blade portion 7'. A tip end portion of the second blade portion 10' is formed into substantially a circular arc shape in response to the shape of the engaging recessed portion 8'.

A description will be made of a usage method of the index cutter I'. First, the first base member 1 of the index cutter I' is set at the standby position (a chain double-dashed line of FIG. 10A). Second, the sheet on which the thumb index is to be formed is loaded onto the engaging recessed portion 8' of the second base member on the front surface 2*a* side, the side of the sheet is made to abut on the back surface 1*b* of the first base member 1, and the sheet is thereby positioned. Third, the first base member 1 is rotated from the standby position to a cutting position (a solid line of FIG. 10A). At this time, a part of the side is cut by the first blade portion 7' and the second blade portion 10'. Finally, the thumb index is formed on the side along the side surface of the engaging protruding portion 5' and the side surface of the engaging recessed portion 8'.

Figure 10B:
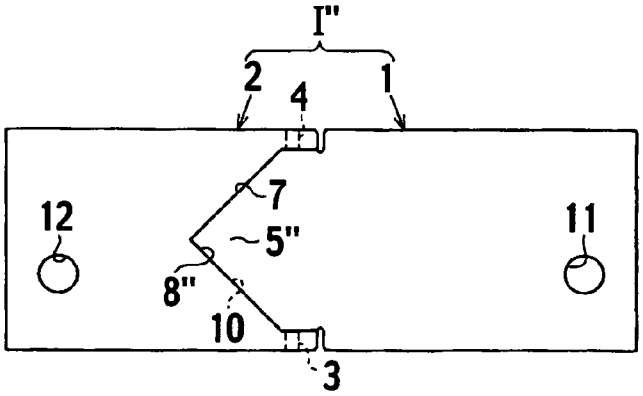
FIG. 10B is a front view for explaining a second modification example of the index cutter according to the embodiment of the present invention.

A description will be made of a second modification example (an index cutter I") of the index cutter I. As shown in FIG. 10B, an engaging protruding portion 5" is formed into a V shape, and is extended from one end of the first base member 1 toward the second base member 2. The engaging protruding portion 5" includes the first inclination surface 6*a*, the second inclination surface 6*b*, and a first blade portion 7". The first blade portion 7" is formed on a tip end portion of the engaging protruding portion 5" on the front surface 1*a* side. A tip end portion of the first blade portion 7" is formed into a V shape in response to the shape of the engaging protruding portion 5". An engaging recessed portion 8" is formed into a V shape, and is extended from one end of the second base member 2 toward the first base member 1. The engaging recessed portion 8" includes the clearance groove 9 and a second blade portion 10". The second blade portion 10" is formed on a tip end portion of the engaging recessed portion 8" on the back surface 2*b* side. A tip end portion of the second blade portion 10" is formed into a V shape in response to a shape of the engaging recessed portion 8".

A description will be made of a third modification example of the index cutter I. The interval D2 between the center point 11*a* and the center point 12*a* is designed to be 108 mm, and conforms to a punch pitch of adjacent holes in three holes of a sheet of a letter size. In this case, the length L of the index cutter is larger than 108 mm. Therefore, before forming, by the puncher, the punch holes on the sheet of the letter size, forming positions of the punch holes to be formed on the sheet can be confirmed by using the first position confirmation hole 11 and the second position confirmation hole 12. As a result, when characters and the like are described on the sheet, it can be avoided that a part of the characters and the like is cut out by the punch holes.

Moreover, a mark is attached onto a position apart by 96 mm from an end portion of the index cutter. Therefore, the sheet of the A4 size can be folded into thirds with reference to the mark concerned.

A description will be made of other modification examples of the index cutter I.

The first position confirmation hole 11 and the second position confirmation hole 12 may be omitted. Moreover, the scales S1, S2 and S3 may be omitted.

The length L of the index cutter I may be changed as appropriate so as be applied to sheets of various sizes. For example, the length L of the index cutter I may be changed to approximate ⅓ (85 mm) of a length of a sheet of the B5 size so that the sheet of the B5 size can be folded into thirds. Moreover, it is desirable that the index cutter I have a thickness within a range from 2.5 mm or more to 3.3 mm or less.

The interval D2 between the center point 11*a* of the first position confirmation hole 11 and the center point 12*a* of the second position confirmation hole 12 may be changed as appropriate so as to be applied to punch pitches of various standards.

The number of position confirmation holes may be changed so as to be applied to the number of holes according to various standards or plural standards. For example, in addition to the first position confirmation hole and the second position confirmation hole, which have the interval of 80 mm therebetween, there may be provided a third position confirmation hole and a fourth position confirmation hole, which have an interval D of 108 mm therebetween.

After the thumb indices 22 are formed on various sheets, the sheets are engaged together by the rings R and R, and the document 20 may be thereby formed.

INDUSTRIAL APPLICABILITY

The index cutter rotates the first base member and the second base member relatively to each other, thereby cutting a part of the desired page group including a small number of pages or a part of the desired page. Accordingly, the index cutter can form the thumb indices on the document, a book, and the like with easiness.

The index cutter is formed compactly into a flat plate shape, and accordingly, can reduce the space for disposing the index cutter itself, and is excellent in portability.

By using the index cutter, the user can perform the formation of the thumb index, the folding of the sheet into thirds, and the position confirmation of the punch holes. Accordingly, the index cutter integrates a plurality of clerical function together.

The invention claimed is:

1. An index cutter configured to form a thumb index on a sheet, comprising:

a flat plate-shaped first base member;

a flat plate-shaped second base member rotatably coupled to a first outer end portion of the first base member at a first outer end portion of the second base member via at least one coupling pin, the second base member also having a second outer end portion opposed to the first outer end portion of the second base member;

an engaging protruding portion protruding from the first outer end portion of the first base member in a direction of a longitudinal axis of the first base member, the engaging protruding portion having a first blade portion at a tip end portion of the engaging protruding portion on a front surface side of the engaging protruding portion; and an engaging recessed portion recessed from the first outer end portion of the second base member in a direction of a longitudinal axis of the second base member, the engaging recessed portion having a second blade portion at a tip end portion of the engaging recessed portion on a back surface side of the engaging recessed portion, wherein, when the first base member is fixed and the second outer end portion of the second base member is pressed so that the back surface side of the engaging recessed portion rotatably approaches the front surface side of the engaging protruding portion, and the engaging protruding portion is received in the engaging recessed portion, a part of the sheet on the engaging protruding portion is cut by the first blade portion and the second blade portion.

2. The index cutter according to claim 1, wherein a side surface of the engaging protruding portion includes:

a first inclination surface inclined from the back surface of the engaging protruding portion toward the second base member; and a second inclination surface continuously connected to the first inclination surface and inclined from the front surface of the engaging protruding portion toward the first base member, and an inclination angle $\theta_2$ ($0° < \theta_2 < 90°$) of the second inclination surface with respect to the front surface is larger than an inclination angle $\theta_1$ ($0° < \theta_1 < 90°$) of the first inclination surface with respect to the front surface.

3. The index cutter according to claim 1, wherein a side surface of the engaging recessed portion is curved into substantially a saddle shape.

4. The index cutter according to claim 1, wherein the index cutter has a flat plate-shape, when the engaging protruding portion is received in the engaging recessed portion.

* * * * *